US005087294A

United States Patent [19]

Rechtzigel

[11] Patent Number: 5,087,294

[45] Date of Patent: Feb. 11, 1992

[54] METHOD AND APPARATUS FOR CLEANING A PETROLEUM PRODUCTS STORAGE TANK

[76] Inventor: Allen Rechtzigel, 10620 Courthouse, Inver Grove, Minn. 55077

[21] Appl. No.: 679,445

[22] Filed: Apr. 2, 1991

[51] Int. Cl.[5] ..... B08B 3/02; B08B 9/093

[52] U.S. Cl. ..... 134/22.1; 134/22.11; 134/22.12; 134/22.18; 134/24; 134/167 R; 134/168 R

[58] Field of Search ..... 134/22.1, 22.11, 22.12, 134/22.18, 24, 167 R, 168 R

[56] References Cited

U.S. PATENT DOCUMENTS

| | | | |
|---|---|---|---|
| 4,426,233 | 1/1984 | Manabe et al. | 134/22.12 |
| 4,642,138 | 2/1987 | Koyase et al. | 134/22.18 |
| 4,828,625 | 5/1989 | Moran | 134/22.18 |

*Primary Examiner*—Theodore Morris
*Assistant Examiner*—Zeinab El-Arini
*Attorney, Agent, or Firm*—Gifford, Groh, Sprinkle, Patmore and Anderson

[57] ABSTRACT

A method and device are provided for cleaning a storage tank for petroleum products of the type having a closed sidewall and a floating roof which floats upon the top of the petroleum products. Additionally, a plurality of downwardly depending legs are removably secured to the floating roof which engage the bottom of the storage tank when it is nearly empty thereby preventing the floating roof from contacting the bottom of the storage tank. The device includes an elongated nozzle having an upper end and a lower end with at least two spray jets adjacent its lower end. One of the legs is removed from the floating roof of the storage tank thereby forming an opening into which the nozzle is inserted so that its lower end is positioned adjacent the bottom of the storage tank. Thereafter, petroleum products under high pressure are pumped through the nozzle and thus through the spray jets. In doing so, the spray jets emulsify dirt, waxes, and other petroleum distillates which accumulate at the bottom of the tank. The above process is repeated for a number of spaced openings along the floating roof of the storage tank.

9 Claims, 1 Drawing Sheet

METHOD AND APPARATUS FOR CLEANING A PETROLEUM PRODUCTS STORAGE TANK

BACKGROUND OF THE INVENTION

I. Field of the Invention

The present invention relates to a method and apparatus for cleaning a storage tank for petroleum products.

II. Description of the Prior Art

In industrial applications, petroleum products are typically stored in large storage tanks. These large storage tanks typically include a closed cylindrical sidewall which forms the reservoir for the petroleum products. A floating roof is then disposed across and covers the open top of the reservoir. These floating roofs, however, float upon the petroleum products contained within the storage tank so that the vertical position of the floating roof varies in accordance with the amount of petroleum products in the storage tank.

The floating roof of the storage tank typically includes a number of radially spaced and vertically extending openings. Each of those radially spaced openings is adapted to removably receive a leg so that, with the leg positioned within the opening and secured to the floating roof, the leg depends downwardly from the floating roof by a predetermined distance, e.g. three feet or six feet. Consequently, when the tank is nearly empty, these legs engage the bottom of the storage tank and prevent the floating roof of the storage tank from contacting the bottom of the storage tank. The floating roof of the storage tank can also include other openings, such as an access opening.

After prolonged use, dirt, waxes and other petroleum distillates tend to accumulate along the bottom of the storage tank. This accumulation at the bottom of the storage tank must be periodically cleaned in order to enable proper functioning of the storage tank.

There have been a number of previously known methods for cleaning the accumulation at the bottom of the storage tank. In one method, one or more openings are formed through the sidewall of the storage tank adjacent its bottom. Petroleum products under high pressure are then pumped through these openings which emulsify the accumulation at the bottom of the storage tank so that the petroleum products with the emulsified accumulation can be pumped and thus removed from the tank.

One disadvantage of this previously known method, however, is that it requires the sidewall of the tank to be breached which is not only expensive, but also may adversely affect the integrity of the tank. Furthermore, while this previously known method is adequate for emulsifying the accumulation adjacent the sidewalls of the tank, it is only partially effective for removing the accumulation near the center of the tank due to the reduced pressure of the injected petroleum products at the center of the tank.

A still further previously known method for cleaning the storage tank is to physically enter the storage tank and manually remove the accumulation. This method, however, is time consuming and very expensive.

SUMMARY OF THE PRESENT INVENTION

The present invention provides both a method and apparatus for cleaning storage tanks for petroleum products which overcomes the disadvantages of the previously known methods.

In brief, the device of the present invention comprises an elongated nozzle having an upper end and a lower end. At least two spray jets are positioned adjacent the lower end of the nozzle and these spray jets face in opposite radial directions from each other.

The nozzle is dimensioned so that, with a leg removed from the floating roof of the storage tank, the nozzle is insertable through the opening formed by the removed leg so that the lower end of the nozzle, and thus the spray jets, are positioned adjacent the bottom of the tank. Thereafter, petroleum products are pumped at high pressure into the upper end of the nozzle so that the petroleum products are discharged from the spray jets and, in doing so, emulsify the accumulation at the bottom of the storage tank.

The nozzle is preferably swivelably mounted to the floating roof of the storage tank so that by rotating the nozzle around a vertical axis, the nozzle emulsifies the accumulation at the bottom of the storage tank in a circular pattern around the leg opening. This process is then repeated for a number of different and radially spaced openings in the floating roof of the storage tank until complete cleaning of the storage tank is obtained.

A primary advantage of the method and device of the present invention is that the storage tank can be rapidly cleaned without breaching the sidewall of the storage tank or by forming additional openings in the floating roof of the storage tank.

BRIEF DESCRIPTION OF THE DRAWINGS

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
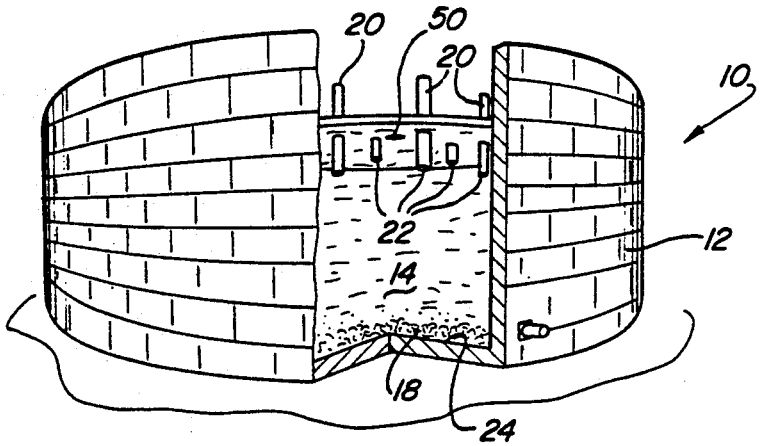
FIG. 1 is a perspective view illustrating a storage tank for petroleum products.

With reference first to FIG. 1, a conventional storage tank 10 for petroleum products is thereshown and comprises a closed cylindrical sidewall 12 which forms a reservoir 14 for the petroleum products. A floating roof 16 overlies the top of the reservoir 14 and floats upon the top of the petroleum products contained within the reservoir 14. Thus, the vertical position of the floating roof 16 varies as a function of the volume of petroleum products within the reservoir 14.

Still referring to FIG. 1, after prolonged use, dirt, waxes, and other debris accumulate along the bottom of the reservoir 14 as shown at 18. It is this accumulation 18 which must be removed from the storage tank 10 in order to permit proper operation of the storage tank 10.

A plurality of support legs 20 are removably secured to the floating roof 16 of the storage tank 10 so that a portion 22 of each leg 20 depends downwardly from the floating roof 16. When the tank 10 is nearly empty of petroleum products in the reservoir 14, these support legs 20 engage the bottom 24 of the storage tank 10 and support the floating roof 16 above the bottom 24 of the storage tank 10 by a small distance, i.e. three feet or six feet.

Figure 3:
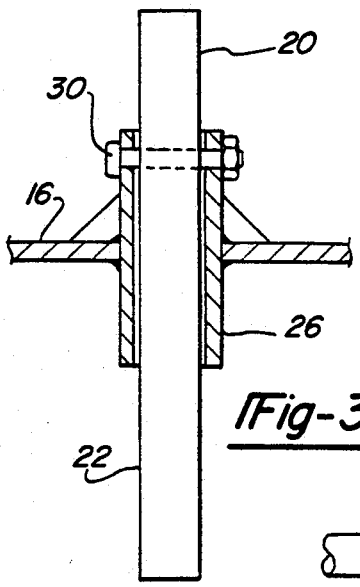
FIG. 3 is an enlarged view illustrating a portion of the storage tank.

With reference now to FIG. 3, one support leg 20 is thereshown in greater detail and comprises an elongated rod or cylinder. The leg 20 is insertable through a tubular cylindrical support tube 26 which is secured to the floating roof 16 in any conventional fashion, such as by welding. Gussets 28 extending between the floating roof 16 and the tube 26 also serve to support the tube 26 so that it extends substantially vertically.

With the leg 20 inserted through the tube 26 as shown in FIG. 3, a lock pin 30 extends through registering openings in both the support tube 26 and the leg 20 to lock the leg 20 to the floating roof 16. This pin 30, however, is removable so that, upon removal of the pin 30, the leg 20 can be removed from the tube 26 thus forming an opening in the floating roof 16.

Figure 2:
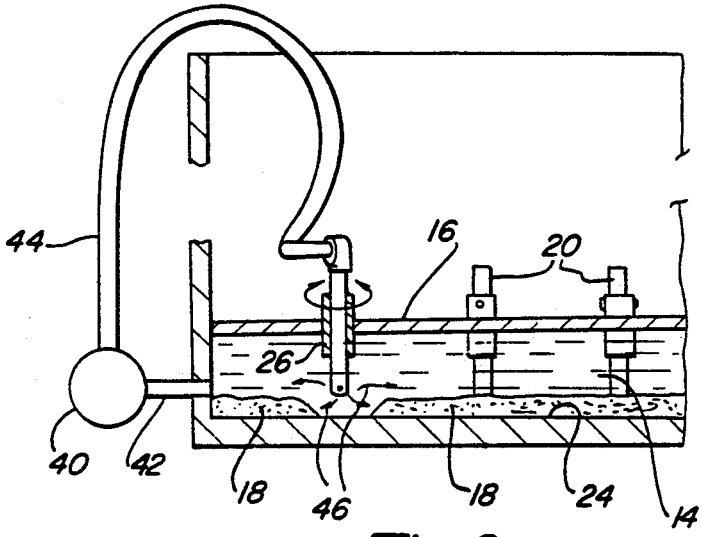
FIG. 2 is a sectional diagrammatic view illustrating the preferred embodiment of the present invention.
Figure 4:
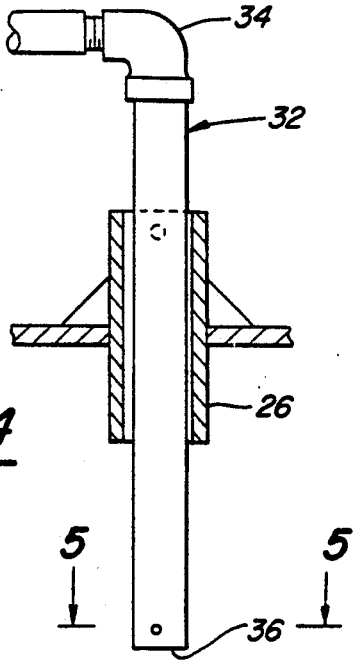
FIG. 4 is an enlarged view showing a portion of the preferred embodiment of the present invention.

With reference now to FIGS. 2 and 4, the device of the present invention comprises an elongated nozzle 32 having an upper end 34 and a closed lower end 36. The nozzle 32 is tubular and cylindrical in shape and is dimensioned so that, with a leg 20 removed from the tube 26, the nozzle 32 can be inserted through the tube 26 so that its lower end 36 is adjacent the bottom 24 of the storage tank 10 as best shown in FIG. 2. Furthermore, since both the tube 26 and the nozzle 32 are cylindrical in shape, the nozzle 32 can swivel 360° about a vertical axis.

Figure 5:
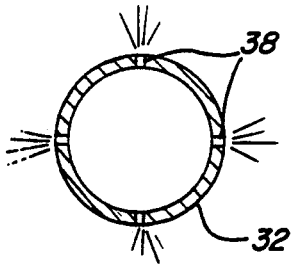
FIG. 5 is a sectional view taken substantially along line 5—5 in FIG. 4 and enlarged for clarity.

With reference now to FIGS. 4 and 5, at least two, and preferably four, openings 38 are formed through the nozzle 32 adjacent its lower end 36. Each opening 38 forms a spray jet as will become shortly apparent. Furthermore, for each opening or spray jet 38, there is a corresponding opening or spray jet 38 facing in the opposite direction. Thus, the radial force of fluid flow through any spray jet 38 is offset by an equal but opposite radial force from its opposing spray jet.

With reference now to FIG. 2, in operation, one leg 20 is removed from its support tube 26 and the nozzle 32 is inserted through the tube 26 in its place. A high pressure pump 40 has its inlet 42 connected to a source of petroleum products, such as the petroleum products contained in the reservoir 14 or a pipeline, and its outlet connected by a hose 44 to the upper or inlet end 34 of the nozzle 32.

Upon activation of the pump 40, the pump 40 pumps the petroleum products from the reservoir 14, through the nozzle 32 and thus through the spray jets 38 shown at 46. Preferably the pump 40 produces pressures between several hundred and several thousand psi at the nozzle 32 so that the effluent from the spray jets 38 emulsifies the accumulation 18 in the storage tank 10 in the area adjacent the nozzle 32. Rotation of the nozzle 32 also removes the accumulation 18 in a substantially circular pattern.

Following emulsification of the accumulation 18 in the storage tank 10 adjacent the opening formed by the tube 26 as shown in FIG. 2, the nozzle 32 is removed and the leg 20 replaced. Thereafter, the above process is repeated at different locations of the leg 20 in the floating roof 16 of the storage tank 10 until the accumulation 18 is completely emulsified. Depending upon the size of the storage tank 10, it is anticipated that the above process would be repeated at six or more different leg locations.

Although the nozzle 32 is preferably inserted through an opening formed by the removal of a support leg 20, other openings in the floating roof 16 can alternatively be used. For example, the floating roof 16 may include an access opening 50 (FIG. 1) through which the nozzle can be inserted.

Having described my invention, however, many modifications thereto will become apparent to those skilled in the art to which it pertains without deviation from the spirit of the invention as defined by the scope of the appended claims.

I claim:

1. A device for cleaning a storage tank for petroleum products, said storage tank having a closed sidewall and a floating roof, said floating roof adapted to float on petroleum contained in said storage tank, said floating roof further comprising at least one opening, a device for cleaning said storage tank comprising:

an elongated nozzle having a longitudinal axis, an upper end and a lower end, said nozzle being axially inserted through said opening in said floating roof so that the lower end is positioned adjacent the bottom of the storage tank, at least two spray jets adjacent the bottom of said nozzle, said spray jets being disposed on diametrically opposed sides of said nozzle, said spray jets having openings which discharge effluent in a direction radially outwardly from said nozzle with respect to said longitudinal axis of said nozzle so that said nozzles discharge effluent in opposite radial directions from said nozzle, means for pumping petroleum products at high pressure into the upper end of said nozzle, whereby said high pressure fluid flow of petroleum products out through said jets emulsifies waxes, debris and other petroleum distillates contained within said storage tank.

2. The invention as defined in claim 1 wherein the floating roof of the storage tank includes a plurality of spaced and downwardly depending legs, said legs being removably secured to spaced openings formed in the floating roof, and where said opening in said floating roof is formed by temporarily removing one of said legs from said floating roof.

3. The invention as defined in claim 1 wherein said pumping means pumps petroleum products from said storage tank to said nozzle..

4. The invention as defined in claim 1 wherein said pumping means pumps petroleum products from said storage tank to said nozzle at a pressure in the range of several hundred to several thousand psi.

5. A method for cleaning a storage tank for petroleum products, said storage tank having a closed sidewall and a floating roof, said floating roof adapted to float on petroleum contained in said storage tank, said floating roof further comprising at least one opening, said cleaning method comprising the steps of:

axially inserting an elongated nozzle having a longitudinal axis, an upper end and a lower end through said opening in said floating roof so that the lower end is positioned adjacent the bottom of the storage tank, said nozzle having at least two spray jets adjacent the bottom of said nozzle, said spray jets being disposed on diametrically opposed sides of said nozzle, said spray jets having openings which discharge effluent in a direction radially outwardly from said nozzle with respect to said longitudinal axis of said nozzle so that said nozzles discharge effluent in opposite radial directions from said nozzle, pumping petroleum products at high pressure into the upper end of said nozzle, whereby high pressure fluid flow of petroleum products out through said jets emulsifies waxes, debris and other petroleum distillates contained within said storage tank.

6. The invention as defined in claim 5 wherein the floating roof of the storage tank includes a plurality of spaced and downwardly depending legs, said legs being removably secured to spaced openings formed in the floating roof, and wherein said method further comprises the steps of:

temporarily removing one of said legs from said floating roof to form the opening, and replacing said leg in said opening following the cleaning operation at said opening.

7. The invention as defined in claim 6 wherein said cleaning method is repeated at a plurality of spaced legs in said floating roof.

8. The invention as defined in claim 5 wherein said pumping step comprises the step of pumping petroleum products from said storage tank to said nozzle.

9. The invention as defined in claim 5 wherein said pumping step pumps petroleum products from said storage tank to said nozzle at a pressure in the range of several hundred to several thousand psi.

* * * * *